US006430752B1

(12) United States Patent
Bay

(10) Patent No.: US 6,430,752 B1
(45) Date of Patent: Aug. 13, 2002

(54) COMPRESSION SHORT

(76) Inventor: Gregory Steven Bay, c/o Sport & Spine Physiotherapy 2111 McCallum Road, Abbotsford, British Columbia (CA), V2S 3N7

( * ) Notice: Subject to any disclaimer, the term of this patent is extended or adjusted under 35 U.S.C. 154(b) by 0 days.

(21) Appl. No.: 10/029,019

(22) Filed: Oct. 25, 2001

(51) Int. Cl.[7] ..... A41D 1/06; A41D 13/02
(52) U.S. Cl. ..... 2/228
(58) Field of Search ..... 2/227, 228, 238, 2/400–408; 450/94, 97, 100, 101, 106, 107, 114, 115, 116, 117, 118, 122, 123, 124, 128, 130, 131, 151, 155

(56) References Cited

U.S. PATENT DOCUMENTS

| | | | | | |
|---|---|---|---|---|---|
| 1,281,538 | A | * | 10/1918 | Dupuy | 450/107 |
| 1,602,429 | A | * | 10/1926 | Gray | 450/94 |
| 2,168,009 | A | * | 8/1939 | Praag | 450/94 |
| RE21,595 | E | * | 10/1940 | Imershein | 450/97 |
| 2,310,864 | A | * | 2/1943 | Pegg | 450/97 |
| 3,073,312 | A | * | 1/1963 | Lobbenberg | 450/97 |
| 3,339,554 | A | * | 9/1967 | Nobbs | 450/94 |
| 3,393,675 | A | * | 7/1968 | Trznadel et al. | 450/100 |
| 3,396,730 | A | * | 8/1968 | Fox | 450/101 |
| 4,862,523 | A | * | 9/1989 | Lipor | 2/409 |
| 5,131,100 | A | | 7/1992 | Atwater et al. | 2/405 |
| 5,205,815 | A | | 4/1993 | Saunders | 602/19 |
| 5,403,271 | A | | 4/1995 | Saunders et al. | 602/60 |
| 6,006,363 | A | | 12/1999 | Karlin | 2/228 |
| 6,023,789 | A | | 2/2000 | Wilson et al | 2/228 |
| 6,041,441 | A | | 3/2000 | Counts et al. | 2/227 |
| 6,146,240 | A | * | 11/2000 | Morris | 450/97 |
| 6,161,222 | A | | 12/2000 | Strickland et al. | 2/228 |

OTHER PUBLICATIONS

Pelvic Compression Short; Information from Website http;// bracesupport.com; dated Sep. 14, 2001.

* cited by examiner

*Primary Examiner*—Gloria M. Hale
(74) *Attorney, Agent, or Firm*—Oyen Wiggs Green & Mutala

(57) ABSTRACT

A compression short is provided which provides specific compression to reduce movement in certain areas of a wearer's body. The short is constructed of a plurality of strips of elastomeric material sewn together. These strips are oriented primarily in diagonal configurations. Two groups of elastomeric strips of fabric extend downwardly across the front portion of the short, and two groups of elastomeric strips of fabric extend downwardly across the rear portion of the short, each group of strips extending from the upper portion of the short downwardly, or diagonally, to the lower portion of the short, from one side to the opposite. Each group extends downwardly at an angle of 40° and 50° from a side seam of the garment. The strips may have a width of between 2 inches and 4 inches.

12 Claims, 5 Drawing Sheets

COMPRESSION SHORT

TECHNICAL FIELD

The present invention relates to garments, and more particularly to garments known generally in the art as compression shorts.

BACKGROUND

Compression shorts are garments worn by individuals for a variety of purposes, but are primarily worn by active individuals and athletes engaged in sports activities. Essentially, a compression short serves as a type of girdle, providing compressive support to various areas of the wearer's body, including the back, hips, pelvis, abdomen, groin and thigh areas. Compression shorts are particularly used by those who have suffered some type of injury to those areas of the body, either for additional support of those areas permanently weakened by injury, or for temporary support of those areas while an injury heals.

Compression shorts are often manufactured using stretchable or elastomeric fabrics such as Lycra™ or Spandex™. Typically, a compression short is constructed such that this elastomeric fabric is placed in tension when the short is pulled onto the wearer's body, thereby providing some degree of compressive support for the wearer. The particular part of the body receiving this compressive support depends upon the nature of the construction of the garment.

There many examples of such compression shorts in the art. For example, U.S. Pat. Nos. 6,041,441 and 6,023,789 are directed to simple athletic shorts constructed of elastomeric fabric having various panels sewn together. U.S. Pat. No. 5,131,100 discloses an athletic compression short which comprises an elastic waistband, a pair of legs formed of stretchable elastic knit fabric and a crotch panel formed of stretchable elastic knit fabric. The front portion of the crotch panel comprises an open mesh wrap. Other relatively simple compression shorts are shown in U.S. Pat. Nos. 5,403,271, 6,006,363 and 6,161,222.

Such simple shorts, although capable of providing some general level of compression to portions of a user's body, generally do not target such compression to a particular area of the wearer's body and not to others; rather, they simply "squeeze" whatever portion of the body the fabric overlies.

Further, such shorts don't necessarily increase resistance to undesired range of movement. In other words, they do not provide specific resistence to certain unidirectional and multidirectional motions. In many instances, limiting certain muscle actions is very important when one is trying to heal from an injury such as an abdominal tear or groin pull. Other prior art shorts have attempted to ameliorate this problem as it relates to the lower back by adding a separate elastomeric belt. An example of such a short is to be found in U.S. Pat. No. 5,205,815. However, this short does not effectively limit certain muscle actions in the abdomen, groin and legs.

Compression wraps to create tension in specific joint and muscle motions have been used for years in sports medicine (i.e. tensor or elastic wraps). Until now there has not been a single garment that reproduces the lower abdominal, pelvic and hip anatomy to provide specific unidirectional and multidirectional support to both muscle action and motion. This garment is designed to create compression for stability and tension to protect injured or recovering muscles. It also may be used to prevent abdominal, pelvic or hip injuries.

There remains, therefore, a pressing need for a compression short which is constructed to provide not only general compressive forces to areas of the body covered by the short, but also to provide specific extra forces to certain areas of the body to limit certain undesired muscle activities in the abdomen, groin and legs. Specifically, a better garment is needed to deal with lower abdominal muscle injuries, pelvic instabilities, and weaknesses in hip-flexor, abductor, extensor, rotator and adductor muscle groups.

SUMMARY OF THE INVENTION

The present invention provides more specific compressive protection to a wearer's body than that provided by prior art shorts. The short of the preferred embodiment of the invention is constructed of a plurality of strips of elastomeric material sewn together to form the short. These strips are oriented primarily in diagonal configurations, which configurations have been determined by the inventor to be particularly helpful in immobilizing, to some extent, a wearer's abdomen, groin, and leg areas, in addition to the wearer's back, hip and pelvic areas.

More particularly, the preferred embodiment of the inventive compression short has a front portion and a rear portion, these portions attached to one another at left and right side seams. Like most traditional shorts, the compression short of the present invention has a waistband encircling the upper edges thereof, and a gusset formed between the front and rear portions of in the crotch area thereof, delineating thereby a trunk portion of the short from a leg portion of the short.

Two groups of elastomeric strips of fabric extend downwardly across the front portion of the short, and two groups of elastomeric strips of fabric extend downwardly across the rear portion of the short, each group of strips extending from the upper portion of the short downwardly, or diagonally, to the lower portion of the short, from one side to the opposite.

In the most preferred embodiment of the invention, the strips, which may comprise elastomeric strips of fabric of the type sewn into men's briefs to act as waistbands (generally known in the art simply as "elastic"), extend downwardly from the respective left and right seams at an angle of between 40° and 50° from the seam. The strips may have a width of between 2 inches and 4 inches. Other strips of the same material may also form the other portions of the short.

BRIEF DESCRIPTION OF DRAWINGS

In drawings which illustrate specific embodiments of the invention, but which should not be construed as restricting the spirit or scope of the invention in any way.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
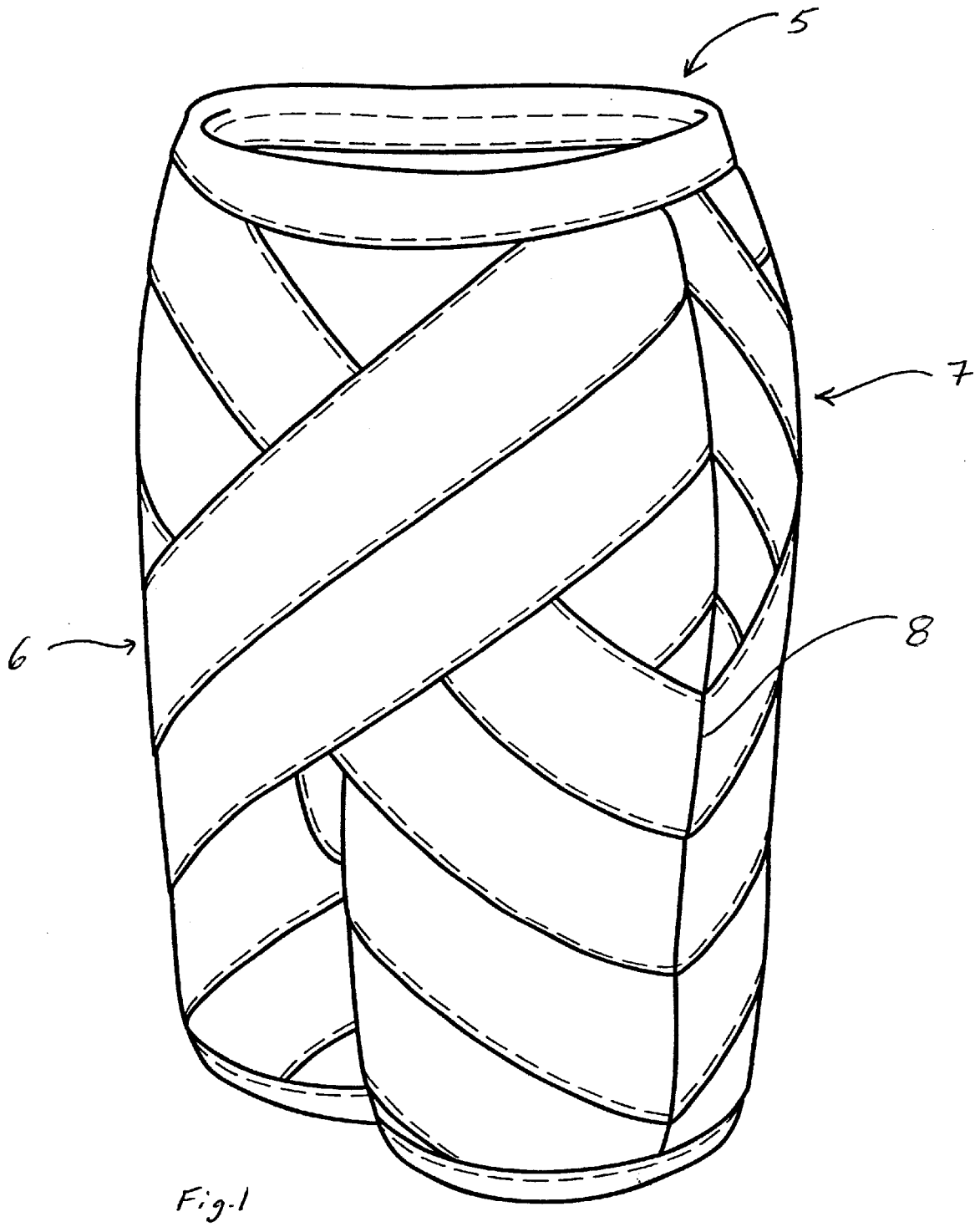
FIG. 1 is a side perspective view of the compression short of one embodiment of the present invention.

Referring first to FIG. 1, one embodiment of the compression short configured in accordance with the principles of the present invention is denoted generally herein by the numeral "5". Short 5 has a front portion 6 and a rear portion 7. Front and rear portions 6, 7 are attached to one another at left and right side seams. Left side seam 8 is shown in FIG. 1. Right side seam 9 is opposite left side seam 8, as shown in FIG. 2.

Figure 2:
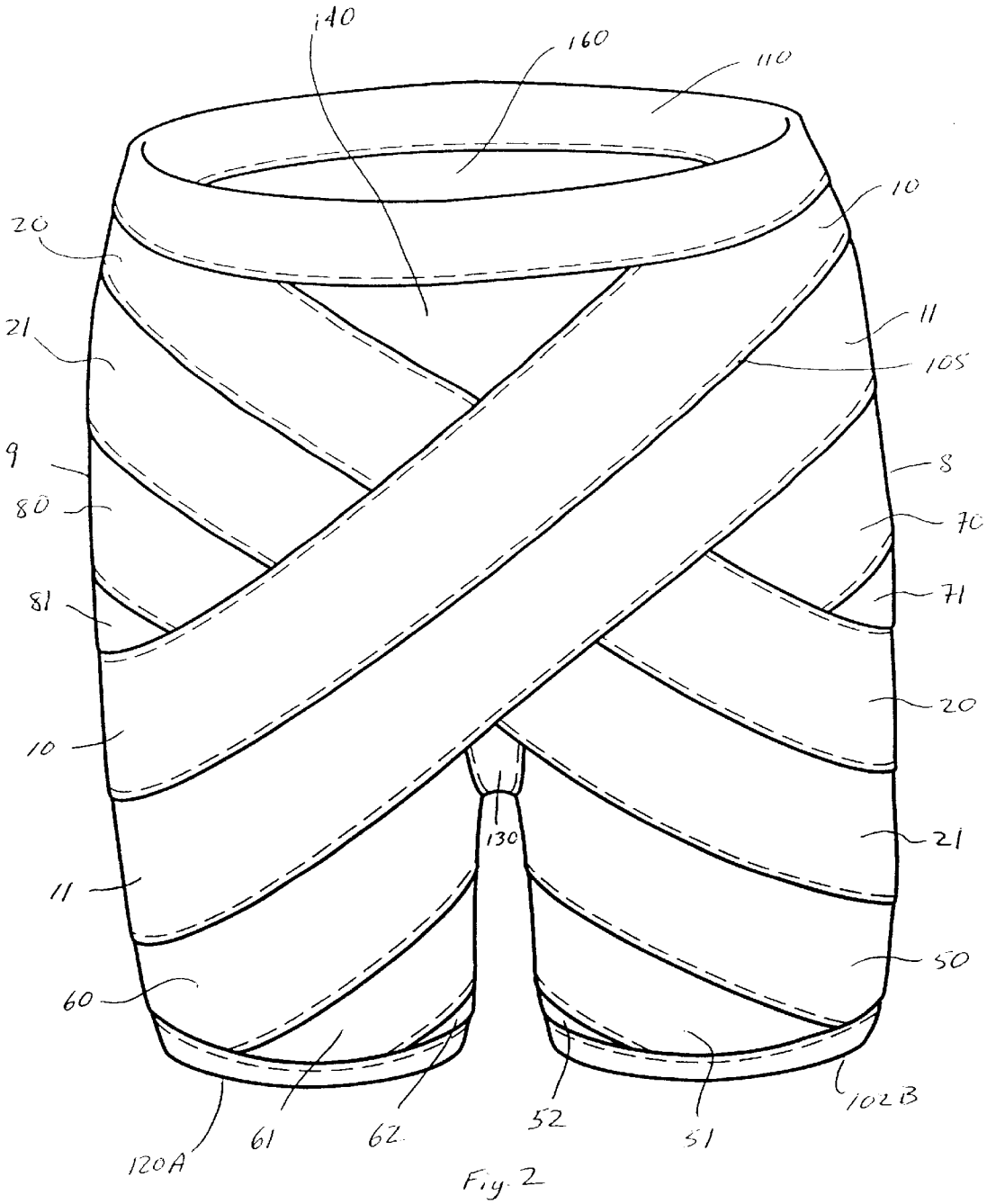
FIG. 2 is a front view of the short illustrated in FIG. 1.

Referring further to FIG. 2, the short 5 of the preferred embodiment of the invention has a waistband 110 which encircles the upper edges of front portion 6 and rear portion 7 of short 5, and also a gusset 130 extending between front and rear portions, 5, 6, although neither waistband 110 nor gusset 130 is strictly necessary to the practise of the invention. Hereafter, "leg portion" describes the general portion of the short 5 below the level of gusset 130 when viewing the short from the front as shown in FIG. 2. "Trunk portion" describes the upper part of short 5, above the level of gusset 130.

As shown in FIG. 2, in the preferred embodiment of the short of the present invention a first plurality 10, 11 of elastomeric strips of fabric extend downwardly across front portion 6 from an upper part of left side seam 8 to a lower part of right side seam 9. It is not essential to the invention that strips 10, 11 originate precisely at seam 8, and terminate precisely at seam 9, but they must extend substantially across the entirety of front portion 6 of short 5.

These strips 10, 11 may be made of any elastomeric material, but the inventor has found it particularly effective to use strips of what is known in the sewing and fabric arts simply as "elastic", the material from which waistbands are often constructed in men's briefs. Such elastic is widely available in many different widths.

A second plurality 20, 21 of elastomeric strips of fabric extend downwardly across front portion 6 from an upper part of right side seam 9 to a lower part of left side seam 8. In FIG. 2, strips 20, 21 are shown crossing underneath strips 10, 11, but it is not essential to have any particular one of these four strips crossing over or under any other one.

Viewing short 5 from the rear (FIG. 3), a third plurality 30, 31 of elastomeric strips of fabric extend downwardly across rear portion 7 from an upper part of left side seam 8 to a lower part of right side seam 9; and a fourth plurality 40, 41 of elastomeric strips of fabric extend downwardly across rear portion 7 from an upper part of right side seam 9 to a lower part of said left side seam 8.

Adjacent strips of fabric are preferably attached to one another along their lengths, and most preferably are sewn together with stitching 105 (FIG. 2).

Figure 4:
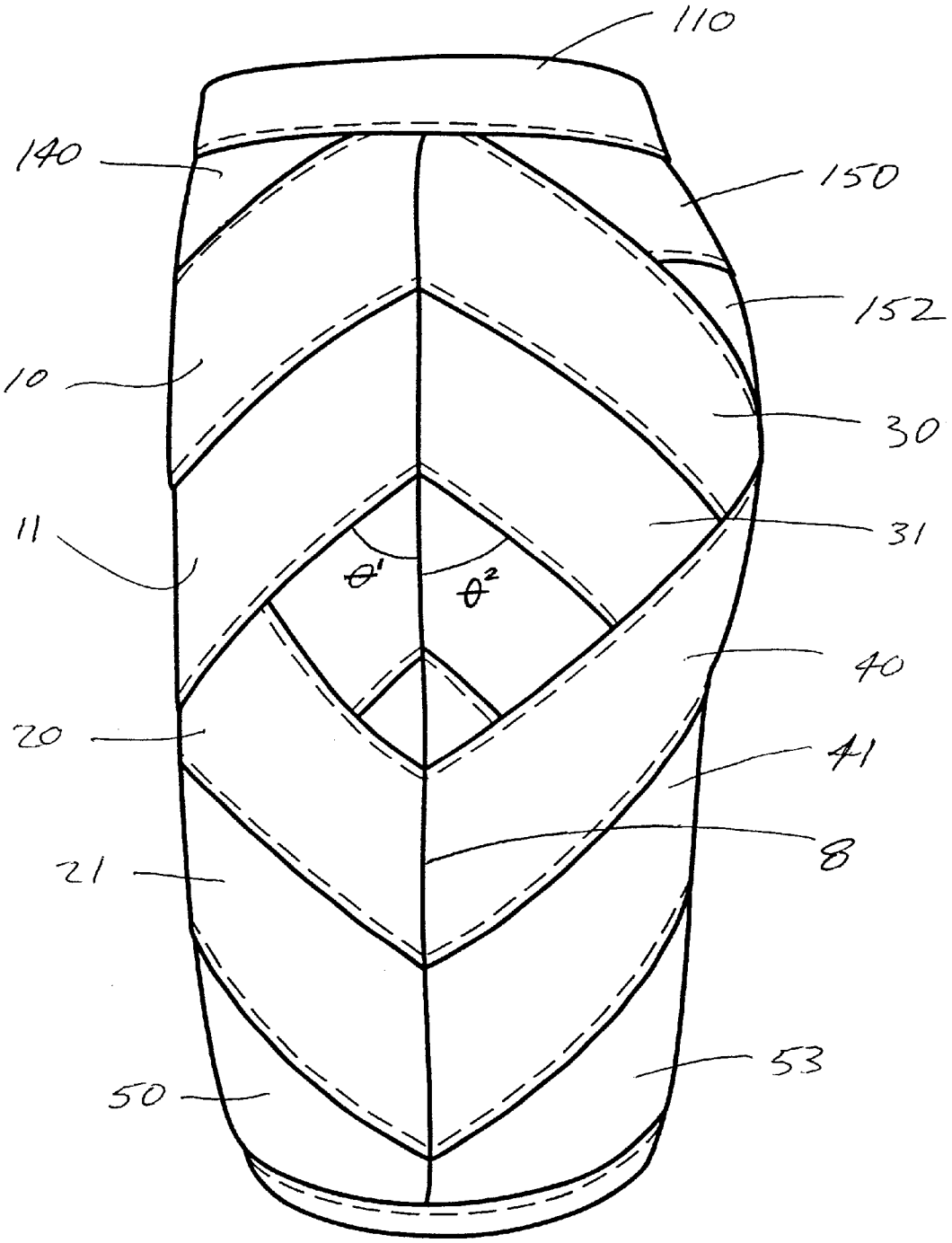
FIG. 4 is a left-side view of the short illustrated in FIG. 1. A right side view would be a mirror-image of this figure.

The inventor has determined that this diagonally criss-crossing configuration of strips of elastomeric fabric is particularly noteworthy to the operation of the invention. Even more particularly, the inventor has recognized that while short 5 could be made with a plurality of fabric strips extending diagonally and downwardly at any angle relative side seams 8, 9, a certain range of "steepness" of such strips provides the preferred results. In particular, the inventor has determined that, relative to side seam 8 (which it will be appreciated is generally vertical when shorts 5 are worn by a wearer who is standing upright), strips 10, 11, 30 and 31 extend downwardly at an angle of between 40° and 50°, and most preferably, at an angle of 45°. In other words, as illustrated in FIG. 4, strips 10, 11 extend forwardly from seam 8 by an angle $\theta^1$ of between 40° and 50°, and strips 30, 31 extend rearwardly from seam 8 by an angle $\theta^2$ of between 40° and 50°.

Similarly, relative to side seam 9, strips 20, 21, 40 and 41 extend downwardly at an angle of between 40° and 50°, and most preferably, at an angle of 45°.

Although it will be appreciated to those skilled in the art that any number of strips of fabric could be employed in place of the strips shown in the figures, the inventor's preferred embodiment employs two strips for each of the first, second, third and fourth pluralities of strips for ease of construction and because good results have been found to have been obtained using this number of strips. Preferably, each of the strips has a width of between 2 inches and 4 inches.

Figure 5:
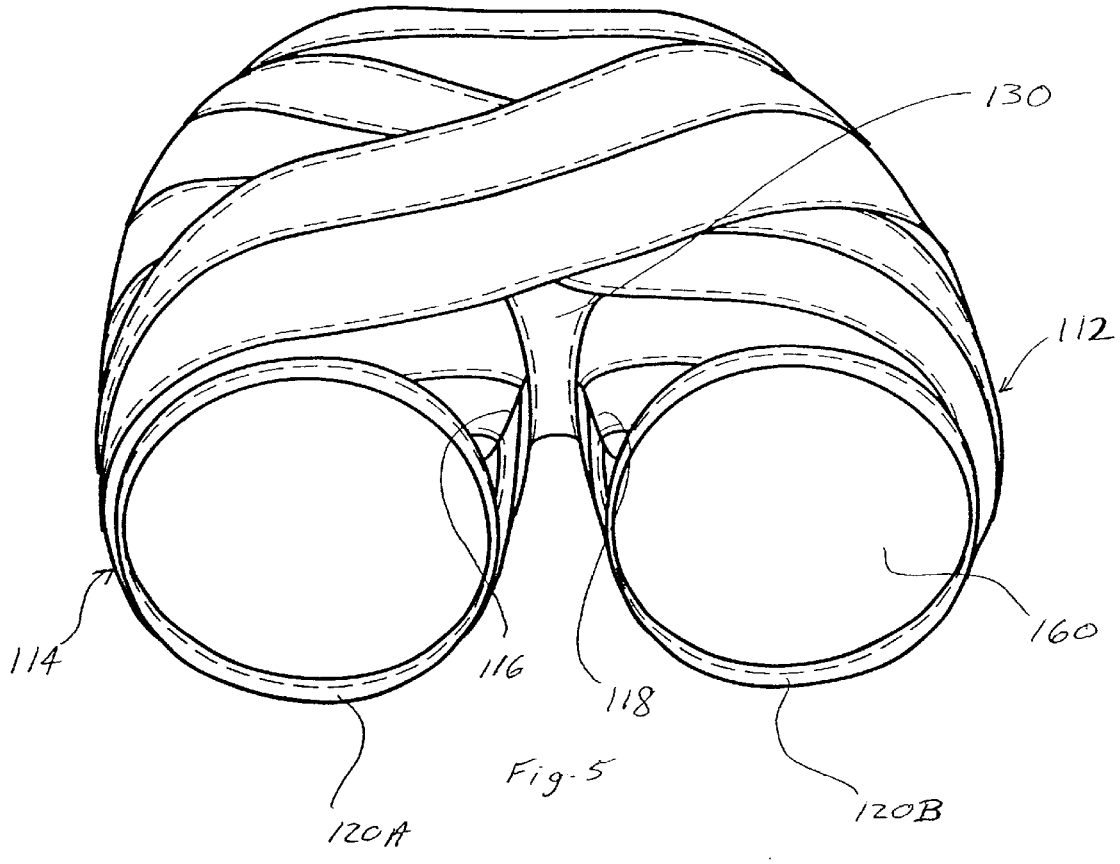
FIG. 5 is a bottom perspective view of the compression short shown in FIG. 1.

As shown throughout the figures, and most particularly in FIG. 5, the leg portion of short 5 has a left leg 112 terminating with cuff 120B and a right leg 114 terminating with cuff 120A. Left leg 112 has a left inseam 118, and right leg 114 has a right inseam 116. Each of legs 112, 114 has an upper portion attached to gusset 130, and each is generally configured to extend at least partially down the thigh of a wearer.

To form leg 112, a fifth plurality 50–55 of elastomeric strips of fabric extend downwardly from left inseam 118. If leg 112 is constructed to be relatively short, strips 50–55 all terminate at cuff 120B, as shown in FIG. 4. However, it will be appreciated that leg 112 may be constructed to be relatively long, and thence some of the fifth plurality of strips may terminate at seam 8.

Leg 114 is formed similarly by a sixth plurality 60–65 of elastomeric strips of fabric which extend downwardly from right inseam 116.

To fill in the space formed between the first plurality of strips 10, 11 and the second plurality of strips 20, 21, and waistband 110, a first horizontal strip of elastomeric material 140 attached to and immediately adjacent waistband is added to short 5. Strip 140 may extend entirely across the front portion 6 of short 5, underlying strips 10, 11, 20 and 21, or may alternatively extending only between strip 10 and strip 20, being sewn to each.

Similarly, a second horizontal strip of elastomeric material 150 may be added to the rear portion 7 of short 5. A third horizontal strip of elastomeric material 152 may be attached to the second horizontal strip 150 to provide more room in short 5 at the back portion 7 thereof.

Figure 3:
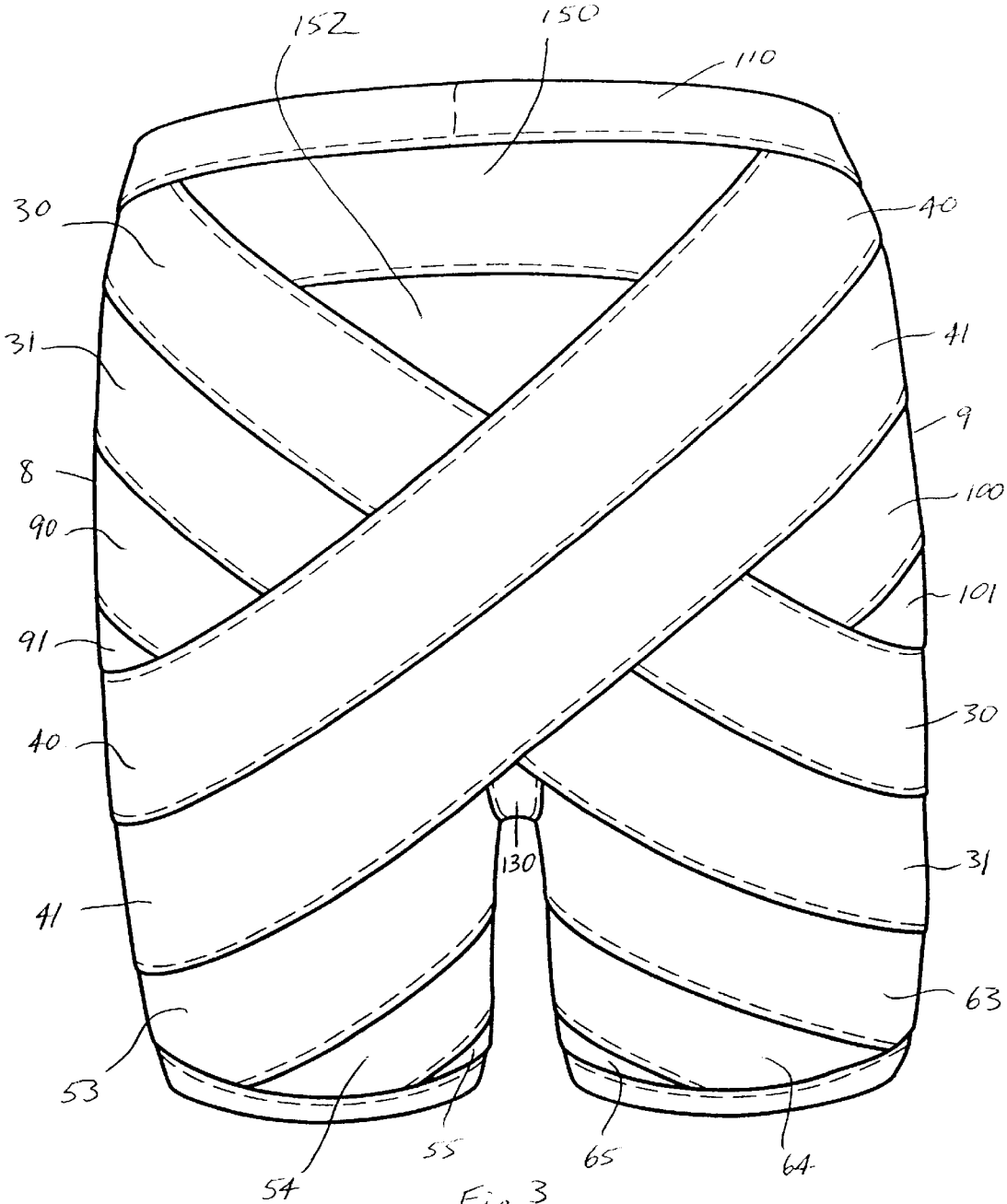
FIG. 3 is a rear view of the short illustrated in FIG. 1.

To fill in the spaces formed at the sides of short 5 formed between the first, second, third and fourth pluralities of elastomeric strips of fabric, seventh, eighth, ninth and tenth pluralities of elastomeric strips of fabric (respectively labeled 70, 71; 80, 81; 90, 91; and 100, 101 in FIGS. 2 and 3), are added, each plurality extending downwardly from a side seam.

Finally, short 5 may be provided with an inner lining 160, for the comfort of the wearer.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A compression short for providing compressive support to areas of the body of a wearer, said compression short comprising:

a) a front portion and a rear portion, said front and rear portions attached to one another at left and right side seams;

b) a first plurality of elastomeric strips of fabric extending downwardly across said front portion from an upper part of said left side seam to a lower part of said right side seam;

c) a second plurality of elastomeric strips of fabric extending downwardly across said front portion from an upper part of said right side seam to a lower part of said left side seam;

d) a third plurality of elastomeric strips of fabric extending downwardly across said rear portion from an upper part of said left side seam to a lower part of said right side seam; and e) a fourth plurality of elastomeric strips of fabric extending downwardly across said rear portion from an upper part of said right side seam to a lower part of said left side seam.

2. A compression short as claimed in claim 1 wherein each one of said first and third pluralities of elastomeric strips of fabric extend downwardly from said left side seam at an angle of between 40° and 50° from said seam, and wherein each one of said second and fourth pluralities of elastomeric strips of fabric extend downwardly from said right side seam at an angle of between 40° and 50° from said seam.

3. A compression short as claimed in claim 2 wherein each one of said pluralities of elastomeric strips of fabric extend downwardly from a seam at an angle of 45°.

4. A compression short as claimed in claim 2 wherein each of said first, second, third and fourth pluralities of elastomeric strips of fabric comprise two elastomeric fabric strips sewn together along longitudinal edges thereof, each of said strips having a width of between 2 inches and 4 inches.

5. A compression short as claimed in claim 4, further comprising:

a) a waistband encircling upper edges of said front and rear portions of said short;

b) a gusset formed between said front and rear portions of said short in a crotch area thereof, delineating thereby a trunk portion of said short from a leg portion of said short.

6. A compression short as claimed in claim 5, wherein said leg portion of said short comprises a left leg having a left inseam and a right leg having a right inseam, each leg having an upper portion at said gusset and a lower end comprising left and right leg holes respectively, the legs thereby configured to extend at least partially down the thigh of a wearer.

7. A compression short as claimed in claim 6, further comprising:

a) a fifth plurality of elastomeric strips of fabric extending downwardly from said left inseam to said left leg hole; and b) a sixth plurality of elastomeric strips of fabric extending downwardly from said right inseam to said right leg hole.

8. A compression short as claimed in claim 7 further comprising:

a) a first horizontal strip of elastomeric material attached to and immediately adjacent said waistband, said first strip extending from said left seam to said right seam across the front portion of said short;

b) a second horizontal strip of elastomeric material attached to and immediately adjacent said waistband, said second strip extending from said left seam to said right seam across the rear portion of said short; and c) a third horizontal strip of elastomeric material attached to and immediately adjacent said second horizontal strip of elastomeric material.

9. A compression short as claimed in claim 7 further comprising:

a) a first horizontal strip of elastomeric material attached to and immediately adjacent said waistband, said first strip extending laterally between said first plurality of elastomeric strips of fabric and said second plurality of elastomeric strips of fabric across the front portion of said short;

b) a second horizontal strip of elastomeric material attached to and immediately adjacent said waistband, said second strip extending laterally between said third plurality of elastomeric strips of fabric and said fourth plurality of elastomeric strips of fabric across the rear portion of said short; and c) a third horizontal strip of elastomeric material attached to and immediately adjacent said second horizontal strip, said third strip also extending laterally between said third and fourth pluralities of elastomeric strips.

10. A compression short as claimed in any one of claims 8 or 9, further comprising:

a) a seventh plurality of elastomeric strips of fabric extending downwardly from said left side seam to said second plurality of elastomeric strips;

b) an eighth plurality of elastomeric strips of fabric extending downwardly from said right side seam to said first plurality of elastomeric strips;

c) a ninth plurality of elastomeric strips of fabric extending downwardly from said left side seam to said fourth plurality of elastomeric strips; and d) a tenth plurality of elastomeric strips of fabric extending downwardly from said right side seam to said third plurality of elastomeric strips, said seventh, eight, ninth and tenth pluralities of elastomeric strips of fabric thereby filling in spaces formed between said first, second, third and fourth pluralities of elastomeric strips of fabric at the sides of said short.

11. A compression short as claimed in claim 10 further comprising a strip of elastomeric material encircling each of said left and right leg holes, thereby forming cuffs at the bottom of said short.

12. A compression short as claimed in claim 11 further comprising an inner liner.

* * * * *